United States Patent [19]

Tsugita

[11] Patent Number: 4,664,542

[45] Date of Patent: May 12, 1987

[54] TEMPERATURE CONTROL DEVICE FOR A PRINTING HEAD

[75] Inventor: Kousaku Tsugita, Ohme, Japan

[73] Assignee: Kabushiki Kaisha Toshiba, Japan

[21] Appl. No.: 771,577

[22] Filed: Aug. 30, 1985

[30] Foreign Application Priority Data

Aug. 31, 1984 [JP] Japan ..... 59-182220

[51] Int. Cl.[4] ..... B41J 3/12

[52] U.S. Cl. ..... 400/124; 400/719; 101/93.05; 361/384

[58] Field of Search ..... 400/54, 120, 124, 719; 346/76 PH; 361/381, 382, 383, 384; 236/1 C, 49, DIG. 9

[56] References Cited

U.S. PATENT DOCUMENTS

| | | | |
|---|---|---|---|
| 3,377,545 | 4/1968 | Treit | 236/1 C |
| 4,496,824 | 1/1985 | Kawai et al. | 400/120 |
| 4,504,751 | 3/1985 | Meier | 318/254 |

FOREIGN PATENT DOCUMENTS

| | | | |
|---|---|---|---|
| 2929417 | 1/1981 | Fed. Rep. of Germany | 361/384 |
| 55-124684 | 9/1980 | Japan | 400/54 |
| 56-54531 | 5/1981 | Japan | 361/383 |
| 56-151583 | 11/1981 | Japan | 400/124 |
| 56-162671 | 12/1981 | Japan | 400/124 |
| 57-148678 | 9/1982 | Japan | 400/719 |
| 57-205179 | 12/1982 | Japan | 400/719 |
| 58-129524 | 8/1983 | Japan | 361/384 |

*Primary Examiner*—Edgar S. Burr
*Assistant Examiner*—David A. Wiecking
*Attorney, Agent, or Firm*—Finnegan, Henderson, Farabow, Garrett & Dunner

[57] ABSTRACT

A printing device operative to reduce a printing speed of a printing head to suppress a heat produced and to operate cooling means or allow the cooling ability to be higher when the printing head has a high temperature at which cooling is required, and operative to reduce a printing speed of the printing head to suppress a heat produced to stop the cooling means or allow the cooling ability to be lower when the printing head has a low temperature at which cooling is not required, thus suppressing an operating noise.

6 Claims, 6 Drawing Figures

TEMPERATURE CONTROL DEVICE FOR A PRINTING HEAD

BACKGROUND OF THE INVENTION

1. Field of the invention

The present invention relates to an improvement in a printing device, and more particularly to a printing device provided with cooling means suitable for a wire dot impact system.

2. Description of the prior art

In recent years, a wide variety of information processing instruments have been developed in accordance with demands for high efficiency in dealing with various kinds of business. With these progresses, printing devices of various systems have been developed.

The representative systems which have been employed in printing devices are, e.g., a wire dot impact system, an ink jet system, and a thermal recording system etc. The printing devices using the wire dot impact system, which is most popular among these systems, have an increasing requirement of low noise in addition to needs of improvement in printing quality and printing speed etc.

The wire dot impact system is operated by driving a plurality of wires by means of solenoids to effect printing operation, resulting in a loud operating noise.

Printing devices using the wire dot impact system are provided with cooling means in order to prevent seizure etc. of the printing head due to heat produced from the printing head.

A cooling fan driven by a motor is ordinarily employed as the cooling means. However, the fan's operating noise is felt to be extremely offensive to the ear in an office environment.

The prior art printing devices are configured such that the cooling fan becomes operative at the same time when the printing device is powered. Accordingly, the operating noise of the cooling fan occurs even when the printing head does not effect printing operation. In addition, because the operating noise is approximately proportional to air draft, there is a tendency that a printing device having a higher cooling effect exhibits a larger operating noise.

To eliminate noises due to the operation of the cooling fan when the printing head is inoperative, a method is proposed to tune the operation of the cooling fan to that of the printing head. However, there is a possibility that such a simple solution results in insufficient cooling effect.

For the reasons stated above, the conventional printing devices are required to always operate the cooling fan in order not to lower cooling effect. As a result, they are extremely noisy because of the operating noise of the cooling fan in addition to the operating noise of the printing head.

SUMMARY OF THE INVENTION

Accordingly, an object of the present invention is to provide a printing device operative to control the operation of cooling means in accordance with a temperature of the printing head thus suppressing the operating noise of the cooling means as much as possible.

Other objects of the present invention will be appreciated from the following description and the attached drawings.

DETAILED DESCRIPTION OF THE PREFERRED EMBODIMENTS

The present invention will be described in detail in conjunction with preferred embodiments shown in the attached drawings.

Figure 1:
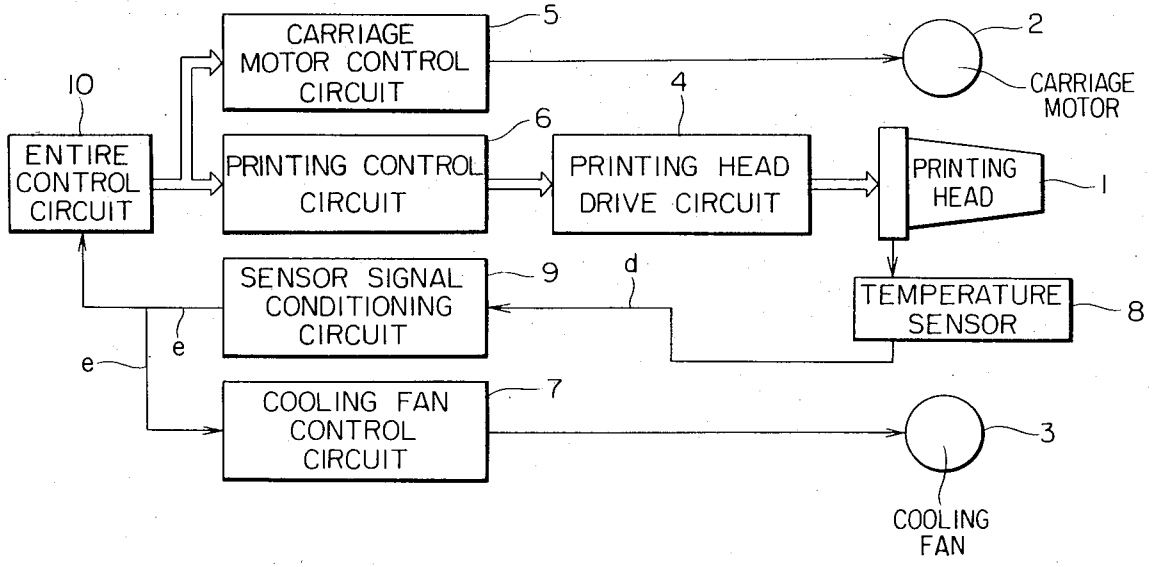
FIG. 1 is a block diagram illustrating a circuit arrangement of a first embodiment of a printing device according to the present invention.
Figure 2:
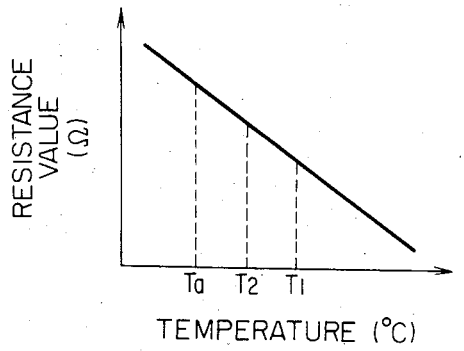
FIG. 2 is a graph showing a temperature characteristic of a temperature sensor employed in the first embodiment shown in FIG. 1.

FIG. 1 shows a circuit arrangement of a first preferred embodiment of a printing device according to the present invention. The printing device comprises a printing head 1 using a wire dot impact system for effecting a printing operation, a carriage motor 2 for moving a carriage (not shown) on which the printing head 1 is mounted, a cooling fan 3 for forcedly cooling the printing head 1, a printing head drive circuit 4 for driving the printing head 1, a carriage motor control circuit 5 for controlling the number of revolutions of the carriage motor 2, a printing control circuit 6 for controlling the operation of the printing head drive circuit 4, and a fan control circuit 7 for controlling the operation of the cooling fan 3. The printing device further comprises a temperature sensor 8 associated with the printing head 1 to sense the temperature of the printing head 1 to produce a corresponding electric signal, a sensor signal conditioning circuit 9 responsive to an output signal from the temperature sensor 8 to produce an information signal to be referred to later, and an entire control circuit 10 to effect a supervisory control of the abovementioned circuits.

The temperature sensor 8 employed in the first embodiment has a temperature-dependent resistance characteristic (a negative temperature characteristic) such that its resistance value decreases as the temperature of the printing head 1 increases.

Figure 3:
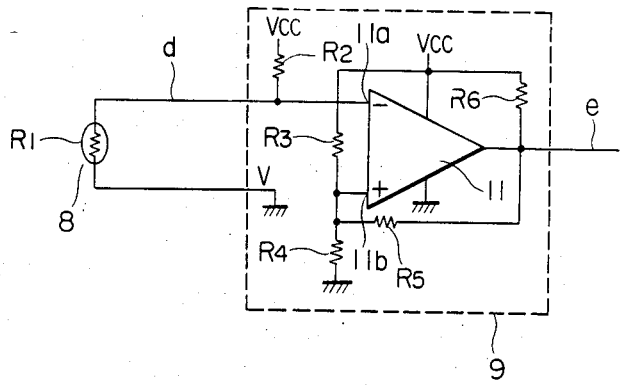
FIG. 3 is a circuit diagram illustrating a signal conditioning circuit employed in the first embodiment shown in FIG. 1.

The sensor signal conditioning circuit 9 comprises, as shown in FIG. 3, a differential amplifier 11 functioning as a hysteresis comparator and resistors $R_2$ to $R_6$. The hysteresis comparator 11 is operative to respond to an input voltage varying according to a resistance level of the temperature sensor 8 constituted by a resistor (negative resistance element) $R_1$ and a reference voltage to produce a predetermined output. Thus, an input voltage determined by the resistor $R_2$ and the resistor $R_1$ constituting the temperature sensor 8 is applied to an inverting input terminal 11*a* of the comparator 11 through a signal line d, and a reference voltage V determined by resistors $R_3$, $R_4$, $R_5$ and $R_6$ is applied to a non-inverting input terminal 11*b* of the comparator 11. A power source of the sensor signal conditioning circuit 9 is represented by $V_{cc}$.

A reference voltage $V_1$ obtained when the temperature of the resistor $R_1$ constituting the temperature sensor 8 is increasing is expressed $$V_1 = V_{cc} \times R_A/(R_A + R_3)$$

where $R_A$ denotes a resultant resistance value of the resistors $R_4$ and $R_5$ connected in parallel.

On the other hand, a reference voltage $V_2$ obtained when temperature of the resistor $R_1$ is decreasing is expressed $$V_2 = V_{cc} \times R_4(R_4 + R_B)$$

where $R_B$ denotes a resultant resistance value of the resistors $R_5$ and $R_6$ connected in parallel.

In this embodiment, when a voltage applied to the inverting input terminal 11*a of* the comparator 11 is less than the reference voltage $V_1$ as a result of an increase in temperature of the resistor $R_1$, the comparator 11 is operative to produce a signal of H level from an output line e. In contrast, when a voltage applied to the inverting input terminal 11*a* of the comparator 11 is above the reference voltage $V_2$ as a result of a decrease in temperature of the resistor $R_1$, the comparator 11 is opearative to produce an output of L level from the output line e.

Figure 4:
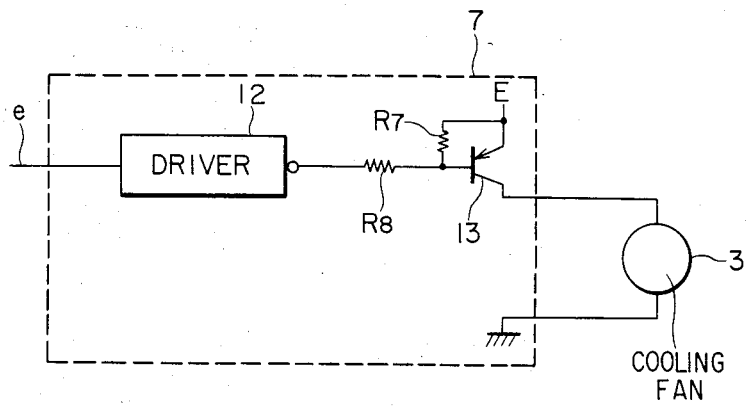
FIG. 4 is a circuit diagram illustrating a fan control circuit employed in the first embodiment shown in FIG. 1.

The cooling fan control circuit 7 in the first embodiment comprises, as shown in FIG. 4, a driver integrated circuit (IC) 12, a pnp transistor 13 for controlling a drive current for the cooling fan 3, a resistor $R_7$ connected between the emitter and the base of the transistor 13, and an input resistor $R_8$.

The driver IC 12 is connected on its input side to the output line e of the comparator 11 provided in the sensor signal conditioning circuit 9 shown in FIG. 3, and is connected on its output side to the base of the transistor 13.

The cooling fan 3 in this embodiment is driven by a dc motor connected between the collector of the transistor 13 and ground. A power source E for driving the dc motor is connected to the emitter of the transistor 13. Accordingly, rotational speed control of the dc motor is carried out by controlling a base current of the transistor 13.

The operation of the printing device in the first embodiment is now described with reference to FIG. 5.

Initially, when the system is powered on, and a print command is fed to the entire control circuit 10, the printing control circuit 6 outputs a signal to the printing head drive circuit 4 to initiate the printing operation of the printing head 1.

Thus, until the temperature (labelled b) of the printing head rises to $T_1$, the resistance value (labelled c) of the temperature sensor 8 linearly decreases according as temperature of the temperature sensor 8 increases. According to this, a voltage (labelled d) applied to the inverting input terminal 11*a* of the comparator 11 also decreases.

Until this voltage lowers to the reference voltage $V_1$, the comparator 11 becomes operative to produce a signal of L level from the output line e. As a result, the driver IC 12 produces an output of H level, with the result that no current flows into the base of the transistor 13. Accordingly, the cooling fan is stopped during this time period.

When the temperature of the temperature sensor 8 rises to $T_1$ and a voltage (labelled d) applied to the inverting input terminal 11*a* of the comparator 11 is lowered to the reference voltage $V_1$, the comparator 11 becomes operative to output a signal of H level from the produce line e. Thus, the output of the driver IC 12 shifts to L level, with the result that a current flows into the base of the transistor 13, thus allowing the cooling fan 3 to be operative.

At this time, the entire control circuit 10 detects that the cooling fan 3 has been operative and produces a signal to the carriage motor control circuit 5 and the printing control circuit 6, thus effecting a control such that the printing speed of the printing head 1 is lowered.

Until the temperature (labelled b) of the printing head 1 lowers to $T_2$ in accordance with the activation of the cooling fan 3 and the lowering of the printing speed, a voltage applied to the inverting input terminal 11*a* of the comparator 11 continues to rise.

At the time when this voltage rises to $V_2$, the comparator 11 becomes operative to produce a signal of L level from the output line e. Thus, the output of the driver IC 12 shifts to H level, with the result that no current flows into the base of the transistor 3, thus allowing cooling fan 3 to be stopped.

At this time, the entire control circuit 10 detects that the cooling fan has been stopped to output a signal to the carriage motor control circuit 5 and the printing control circuit 6, thus increasing the printing speed of the printing head 1 to effect a control such that printing speed is returned to a normal speed.

The above-mentioned operation is repeatedly carried out until the completion of printing operation.

In accordance with the printing device in this embodiment, an increase in the temperature of the printing head 1 is caused due to the printing operation, and at the time when the temperature rises to $T_1$, the cooling fan 3 becomes operative and the printing operation is effected at a reduced printing speed. Thus, a decrease in the temperature of the printing head 1 occurs. At the time when the temperature lowers to $T_2$, the cooling fan 3 is stopped and the printing head 1 is returned to a normal operation.

Accordingly, when the temperature of the printing head 1 rises to a relatively small extent, the cooling fan 3 is inoperative. Accordingly, for most of a time interval during which the printing head effects a printing operation, the cooling fan 3 is not activated and there is no possibility that the cooling effect is lowered.

A second preferred embodiment of a printing device will now be described with reference to FIG. 6.

The elementary configuration of the printing device in the second embodiment is common to that in the first embodiment except for the circuit configuration of the fan control circuit, and therefore the explanation in connection with the common parts will be omitted.

Figure 6:
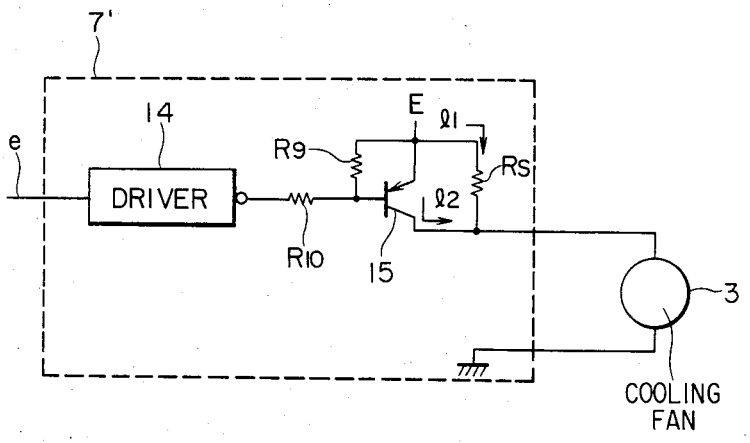
FIG. 6 is a circuit diagram illustrating a fan control circuit employed in a second embodiment of a printing device according to the present invention.

As shown in FIG. 6, the fan control circuit 7' in this embodiment comprises a driver IC 14, a transistor 15 for controlling a drive current for the cooling fan 3, and resistors $R_9$, $R_{10}$ and $R_S$.

The driver IC 14 is connected on its input side to the output line e of the comparator 11 provided in the sensor signal conditioning circuit 9 shown in FIG. 3 and on its output side to the base of the transistor 15.

In a manner similar to the first embodiment, the cooling fan 3 is driven by a dc motor connected between the collector of the transistor 13 and ground. A power source E for driving the DC motor is connected to the emitter of the transistor 15.

The fan control circuit 7' in this embodiment is characterized in that a bypassing resistor $R_S$ is connected between the emitter and the collector of the transistor 15.

Figure 5:
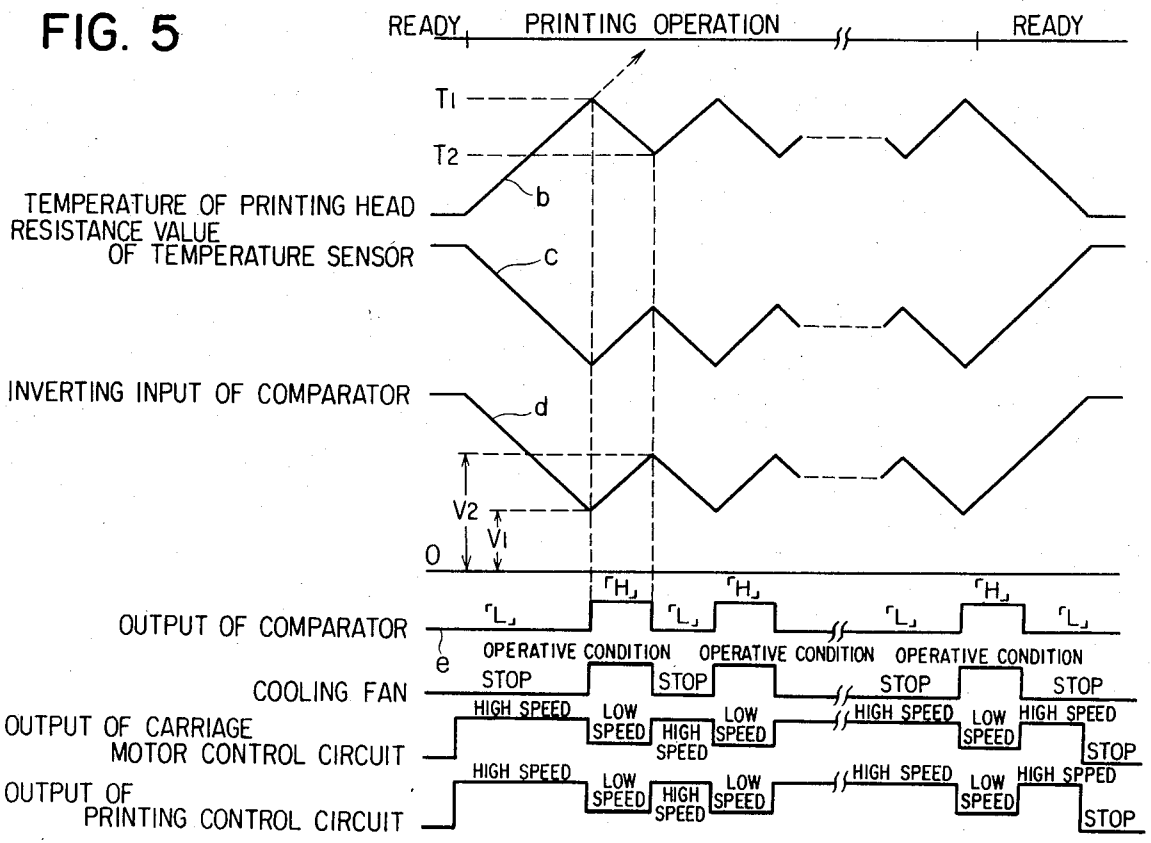
FIG. 5 is a time chart showing an operational sequence in the first embodiment shown in FIG. 1.

In this embodiment, when the temperature of the printing head 1 is less than $T_1$ shown in FIG. 5 and the comparator 11 is operative to produce a signal of L level from the output line e, the driver IC 14 produces an output of H level, with the result that no current flows into the base of the transistor 15. Accordingly, the voltage obtained by substracting the value corresponding to a lower voltage drop by the resistor $R_S$ from a supply voltage from the power supply line E is applied to the cooling fan 3 through the resistor $R_S$ (route $l_1$). As a result, the cooling fan 3 rotates at a reduced speed.

At the time when the temperature of the printing head 1 rises to $T_1$, the comparator 11 becomes operative to produce a signal of H level from the output line e. As a result, the output of the driver IC 14 shifts to L level, with the result that a current flows into the base of the transistor 15 to turn on the transistor 15. Thus, a supply voltage is directly applied from the power supply line E to the cooling fan 3 (route $l_2$ excluding the resistor $R_S$). As a result, the cooling fan 3 rotates at a normal speed.

In a manner similar to the first embodiment, the printing speed control is effected such that when the cooling fan 3 rotates at a normal speed, the printing head effects a printing operation at a reduced speed, while when it rotates at a reduced speed, the printing head effects a printing operation at a normal speed.

The fan control circuit 7 in the above-mentioned first embodiment is configured so that the cooling fan 3 becomes operative at the time when the temperature of the printing head 1 rises to $T_1$ and it is stopped at the time when the temperature of the printing head 1 lowers to $T_2$. In contrast, the fan control circuit 7' in the second embodiment is configured so that the cooling fan 3 rotates at a reduced speed and then rotates at a normal speed at the time when the temperature of the printing head 1 rises to $T_1$, and it rotates at a reduced speed at the time when the temperature of the printing head 1 lowers to $T_2$. It is to be noted that the cooling fan rotates at a reduced speed until the temperature of the printing head 1 rises to $T_1$ in the second embodiment.

The fan control circuits employed in the first and second embodiments may be selectively used depending upon conditions required for the cooling fan and conditions required for printing speed of the printing head.

In the above-mentioned embodiments, a dc motor is used as a motor for driving the cooling fan 3. However, the both embodiments are not limited to the dc motor.

For instance, the employment of an ac motor as a motor for driving the cooling fan may allow the both embodiments to be put into practice by providing control means which can control rotational speed of the ac motor to control the rotational speed of the cooling fan in accordance with the temperature of the printing head.

I claim:

1. A temperature control device for a wire dot impact printing head, comprising:

means for cooling said printing head, said cooling means including a cooling fan;

means for sensing the temperature of said printing head, said temperature sensing means including a signal processing circuit having a negative resistance element that exhibits a resistance value indicative of the temperature of said printing head, said circuit generating a first signal when said negative resistance element exhibits a first resistance value indicative of a first predetermined temperature and generating a second signal when said negative resistance element exhibits a second resistance value indicative of a second predetermined temperature, said second predetermined temperature being lower than said first predetermined temperature; and means responsive to said temperature sensing means for controlling the printing speed of said printing head and for controlling operation of said cooling fan to cool said printing head while minimizing noise, said control means reducing the printing speed of said printing head from a normal printing speed to a non-zero lower printing speed and operating said cooling fan when said signal processing circuit generates said first signal, and said control means restoring the printing speed of said printing head to said normal printing speed and stopping operation of said cooling fan when said signal processing circuit generates said second signal.

2. The device as set forth in claim 1, wherein said cooling fan is driven by a dc motor.

3. The device as set forth in claim 1, wherein said control means includes an integrated circuit driver and a transistor, said integrated circuit driver having an input terminal connected to an output terminal of said signal processing circuit, and said transistor having a base connected to an output terminal of said integrated circuit driver, an emitter connected to a power source, and a collector connected to a power supply line for said cooling fan.

4. A temperature control device for a wire dot impact printing head, comprising:

means for cooling said printing head, said cooling means including a cooling fan;

means for sensing the temperature of said printing head, said temperature sensing means including a signal processing circuit having a negative resistance element that exhibits a resistance value indicative of the temperature of said printing head, said circuit generating a first signal when said negative resistance element exhibits a first resistance value indicative of a first predetermined temperature and generating a second signal when said negative resistance element exhibits a second resistance value indicative of a second predetermined temperature, said second predetermined temperature being lower than said first predetermined temperature; and means responsive to said temperature sensing means for controlling the printing speed of said printing head and for controlling the operating speed of said cooling fan to cool said printing head while minimizing noise, said control means reducing the printing speed of said printing head from a normal printing speed to a non-zero lower printing speed and increasing the operating speed of said cooling fan from a non-zero normal operating speed to a higher operating speed when said signal processing circuit generates said first signal, and said control means restoring the printing speed of said printing head to said normal printing speed and restoring the operating speed of said cooling fan to said normal operating speed when said signal processing circuit generates said second signal.

5. The device as set forth in claim 4, wherein said cooling fan is driven by a dc motor.

6. The device as set forth in claim 4, wherein said control means includes an integrated circuit driver and a transistor, said integrated circuit driver having an input terminal connected to an output terminal of said signal processing circuit, and said transistor having a base connected to an output terminal of said integrated circuit driver, an emitter connected to a power source, and a collector connected to a power supply line for said cooling fan.

* * * * *